United States Patent [19]

Hirosaki et al.

[11] Patent Number: 4,637,296

[45] Date of Patent: Jan. 20, 1987

[54] AIR FLOW CONTROLLING APPARATUS

[75] Inventors: Yoshihiko Hirosaki; Nobuharu Takata, both of Hyogo, Japan

[73] Assignee: Mitsubishi Denki Kabushiki Kaisha, Tokyo, Japan

[21] Appl. No.: 624,949

[22] Filed: Jun. 26, 1984

[30] Foreign Application Priority Data

Jun. 27, 1983 [JP] Japan ..... 58-117511

[51] Int. Cl.[4] ..... F24F 7/00; H02J 9/06

[52] U.S. Cl. ..... 98/1; 307/66; 126/287.5

[58] Field of Search ..... 98/1, 116; 122/479 D, 122/479 R, DIG. 7; 307/66, 87; 126/285 R, 285.5, 287.5

[56] References Cited

U.S. PATENT DOCUMENTS

| | | | |
|---|---|---|---|
| 3,784,892 | 1/1974 | Zelina | 307/66 |
| 3,791,351 | 2/1974 | Kent | 122/479 D |
| 4,129,811 | 12/1978 | Pearson | 307/66 |
| 4,237,385 | 12/1980 | Jurgens et al. | 307/66 |
| 4,255,697 | 3/1981 | Buhler, III | 307/66 |
| 4,432,272 | 2/1984 | Becelaere | 98/1 |
| 4,490,624 | 12/1984 | Luker | 307/66 |

*Primary Examiner*—Henry C. Yuen

*Attorney, Agent, or Firm*—Bernard, Rothwell & Brown

[57] ABSTRACT

An air flow controlling apparatus for accomplishing blasting with a desired air flow by controlling an electric motor for a ventilator for feeding air for combustion to a boiler as well as a damper located in an air course. In order to control a temporary increase or decrease of an air flow due to a variation of a rotational frequency of the electric motor when power supply to the electric motor is changed over between a commercial power source and a variable frequency power source, the apparatus includes a preceding controlling signal generating means which regulates the opening of the damper for a period of time from a point of time at which a power source changing over instruction is received to another point of time at which an actual changing over operation is performed.

2 Claims, 8 Drawing Figures

AIR FLOW CONTROLLING APPARATUS

BACKGROUND OF THE INVENTION

1. Field of the Invention

This invention relates to an air flow controlling apparatus for controlling a flow of air which is fed along an air course communicating, for example, with a boiler or the like.

Particularly, the present invention relates to an improvement in an air flow controlling apparatus for stabilizing an air flow when power supply to an electric motor for driving a ventilator which is to be controlled in ventilation is changed over between a commercial power source and a variable frequency power source.

2. Description of the Prior Art

Normally, control of an air flow is preferably with supply of power from a variable frequency power source from the point of view of saving of power. However, when a trouble occurs in such a variable frequency power source or when power which exceeds the capacity of a variable frequency power source (the capacity is limited in most cases to some low value from the point of view of a cost and so on) must be supplied to an electric motor, it becomes necessary to connect a commercial power source to the electric motor. Accordingly, it is sometimes necessary to effect changing over between a variable frequency power source and a commercial power source.

An air flow controlling apparatus of such a conventional type will be described below with reference to FIGS. 1 to 4 of the accompanying drawings.

FIG. 1 is a diagrammatic representation of a general construction of a conventional apparatus, partly shown in circuit diagram. In FIG. 1, reference numeral 1 designates a commercial power source (hereinafter referred to as "C power source"), 2 a variable frequency power source for receiving power from the C power source 1 and for supplying power having a converted frequency (hereinafter referred to as "V power source"), and 3 an electric motor which receives and is driven to rotate by power alternatively from the C power source 1 or the V power supply 2. The alternative supply of power is attained by selective opening and closing operations of a switch 4 interposed between the C power source 1 and the V power source 2, another switch 5 interposed between the V power source 2 and the electric motor 3, and a further switch 6 interposed between the C power source 1 and the electric motor 3. Reference numerals 4-1, 5-1 and 6-1 designate contacts which are opened and closed in response to opening and closing operations of the switches 4, 5 and 6, respectively. Further in FIG. 1, reference numeral 7 denotes an air course communicating from an entrance 7*a* to an exit 7*b* thereof to form an air course for a wind, a ventilator located in the air course 7 for receiving a rotational force of the electric motor 3 by way, for example, of a belt or the like to produce a wind, 9 a damper located in the air course 7 for adjusting resistance of the air course 7, and 10 an air course resistance controlling mechanism for controlling resistance in ventilating the air course 7. The air course resistance controlling mechanism 10 is connected to the damper 9 by means of a connecting bar 11 so as to adjust the opening of the damper 9 while the rotational frequency of the ventilator 8 is varied to control an air flow. Further in FIG. 1, reference numeral 12 designates a controlling value generator which produces a controlling value signal representative of the opening of the damper 9 and delivers it to the air course resistance controlling mechanism 10. The controlling value generator 12 includes a fixed value generating section 12*a* which provides a controlling value signal of a fixed value independently of an air flow of a load, and a variable value generating section 12*b* which provides a controlling value signal which is functional, for example, proportional to a load air flow. Reference numerals 13-1 and 13-2 designate controlling value change-over switches which are interlocked to each other to open and close, and to close and open, respectively, to alternatively couple controlling value signals produced from the fixed value generating section 12*a* and from the variable value generating section 12*b* to the air course resistance controlling mechanism 10. The change-over switch 13-1 is connected in series to the contacts 4-1, 5-1 between the fixed value generating section 12*a* and the air course resistance controlling mechanism 10 while the other change-over switch 13-2 is connected in parallel with the contact 6-1 between the variable value generating section 12*b* and the air course resistance controlling mechanism 10. Thus, the air course resistance controlling mechanism 10, the controlling value generator 12, and so on, constitute a damper controlling device.

FIG. 2 is a diagram showing relationships between the load air flow and the opening of the damper. In the diagram of FIG. 2, a straight line I illustrates the relationship where the damper opening is constant irrespective of the load air flow while another straight line II illustrates the relationship where the damper opening is in proportion to the load air flow. The fixed value generating section 12*a* produces a controlling value signal which varies in accordance with the straight line I while the variable value generating section 12*b* produces a controlling value signal which varies in accordance with the straight line II.

FIGS. 3 and 4 are diagrams showing characteristics upon changing over between the two power sources, FIG. 3 being a diagram upon changing over from the C power source to the V power source, and FIG. 4 being a diagram upon changing over from the V power source to the C power source. In both figures, curved lines IIIa and IIIb illustrate variations in the rotational frequency of the electric motor 3 relative to the time, curved lines IVa and IVb illustrate variations in the opening of the damper 9 relative to the time, and curved lines Va and Vb illustrate variations in the air flow relative to the time.

Now, operations of the conventional apparatus having the construction as described above will be described.

The electric motor 3 is driven from the V power source 2 to rotate the air blower 8 when the switches 4, 5 are in their respective closed positions while the switch 6 is in its open position. On the contrary, when the switches 4, 5 are in their open positions while the switch 6 is in its closed position, the electric motor 3 is driven from the C power source to rotate the air blower 8.

When the electric motor 3 is driven from the C power source 1, it is always rotated at a constant speed, and accordingly, a controlling operation for obtaining a predetermined load air flow is effected by adjustment of the opening of the damper 9. In particular, due to the fact that the contact 6-1 is closed, a controlling value signal is delivered from the variable value generating section 12*b* to the air course resistance controlling mechanism 10 so that the air course resistance controlling mechanism 10 operates in response to the controlling value signal to adjust the opening of the damper 9 by way of the connecting bar 11 so as to meet the relationship as represented by the straight line II of FIG. 2 to maintain the air flow to a predetermined level.

On the contrary, when the electric motor 3 is driven from the V power source 2, the speed of the motor 3 can be varied, and accordingly, a controlling operation for maintaining a predetermined air flow can be effected by controlling the rotational frequency of the air blower 8 which is driven by the electric motor 3. In this case, a controlling value signal is delivered from the fixed value generating section 12*a* to the air course resistance controlling mechanism 10 by way of the contacts 4-1 and 5-1 and the change-over switch 13-1 so that the air course resistance controlling mechanism 10 operates the damper 9, in response to the controlling value signal, so as to meet the relationship as represented by the straight line I of FIG. 2, that is, so as to maintain the air flow to a predetermined level.

It is to be noted here that, when an air flow is to be produced while the electric motor 3 is driven from the C power source 1, the opening of the damper 9 is reduced and hence causes a loss of power, but a parallel provision of two power sources is still employed as described hereinabove because there are some cases in which supply of power from the C power source 1 is necessitated, such as, upon occurrence of a trouble in the V power source 2, and so on, as described hereinabove.

Operations upon changing over between the two power sources will be described below.

At first, a changing over operation from the C power source 1 to the V power source 2 will be described. It is assumed that a C to V changing over switch not shown is thrown in at a time $t_1$ as shown in FIG. 3. Then, immediately the switch 6 is opened and the switch 4 is closed. As a result, supply of power to the electric motor 3 is stopped and hence the rotational frequency of the electric motor 3 decreases gradually as indicated by the curved line IIIa of FIG. 3. In this instance, the damper 9 increases its opening gradually as indicated by the curved line IVa of FIG. 3 so as to maintain the air flow constant. Then, at a point of time $t_2$ at which the rotational frequency of the electric motor 3 is lowered to a predetermined level determined by the power supplied from the V power source 2, the switch 5 is closed. Meanwhile, increase of the opening of the damper 9 is stopped when an opening is reached which is defined by the straight line I of FIG. 2 when the air flow is controlled by a rotational frequency controlling method in which power is supplied from the V power source. During the changing over operation, the air flow temporarily falls significantly below the predetermined level as indicated by the curved line Va of FIG. 3.

Now, a changing over operation from the V power source 2 to the C power source 1 will be described. In this case, before a V to C changing over switch not shown is thrown in, for example an operator manually operates repetitively to open and close the change-over switches 13-1, 13-2 to raise the speed of the electric motor 3 until a maximum rotational frequency is reached which is determined by power supplied from the V power source 2 while maintaining an air flow, and the opening of the damper 9 is also adjusted in accordance with the frequency: this is to prevent a shock or the like which may otherwise be caused by a large variation in rotational frequency upon changing over from the V power source 2 to the C power source 1 when the changing over is effected directly without any preparatory operation. Thus, at a point of time $t_3$ (refer to FIG. 4) at which the rotational frequency of the electric motor 3 is in its stabilized condition after it has been raised to the maximum rotational frequency determined by the power supplied from the V power source 2, the V to C changing over switch not shown is at last thrown in. This immediately opens the switches 4, 5 and closes the switch 6 to connect the C power source 1 to the electric motor 3. Consequently, the rotational frequency of the electric motor 3 is increased gradually to a particular rotational frequency which is determined by the power supplied from the C power source 1 as shown by the curved line IIIb of FIG. 4, and after the particular rotational frequency has been reached, the rotation of the electric motor 3 is maintained in a stabilized condition. In this instance, the contact 6-1 is closed in response to closing of the switch 6 so that a signal from the variable value generating section 12*b* is coupled to the air course resistance controlling mechanism 10 to adjust the opening of the damper 9 to the load (refer to the straight line II of FIG. 2 and the curved line IVb of FIG. 4). During this changing over operation, the air flow temporarily increases high above the predetermined level as indicated by the curved line Vb of FIG. 4.

Thus, since the conventional air flow controlling apparatus has a construction which does not allow operations of the damper 9 to follow increasing and decreasing variations of the rotational frequency of the electric motor 3, that is, which does not allow harmonization of the opening and closing speed of the damper 9 with the increasing and decreasing variation of the rotational frequency of the electric motor 3 as described hereinabove, it is disadvantageous in that a large variation of the air flow is involved in a changing over operation of the apparatus. Moreover, as there is some time lag between the changing over operation of the C to V & V to C changing over switches and the damper start, the variation of the air flow becomes larger. In addition, when the air course 7 of the apparatus is connected, for example, to a boiler, the air flow to the boiler upon a changing over operation as described above is rendered unstable, resulting in instability of combustion in the boiler. Thus, it is a problem that a safe running of the boiler cannot be attained.

SUMMARY OF THE INVENTION

It is an object of the present invention to provide an air flow controlling apparatus which allows a predetermined air flow to be maintained in a stabilized condition even upon changing over between a commercial power source and a variable frequency power source.

In order to accomplish the object of the invention, an air flow controlling apparatus according to the invention includes a preceding driving means for producing a preceding controlling signal for adjusting the opening of a damper prior to an operation of changing over means including switches and so on in response to a changing over instruction to change over from a commercial power source to a variable frequency power source or vice versa, and a changing over time harmonizing means for rendering the changing over means operative after lapse of a predetermined period of time after production of the preceding controlling signal.

The preceding controlling signal has a value which varies in time in accordance with a predetermined function so as to control a temporary variation of the air flow arising from the variation of the rotational frequency of an electric motor upon changing over between power sources.

DESCRIPTION OF THE PREFERRED EMBODIMENTS

Figure 1:
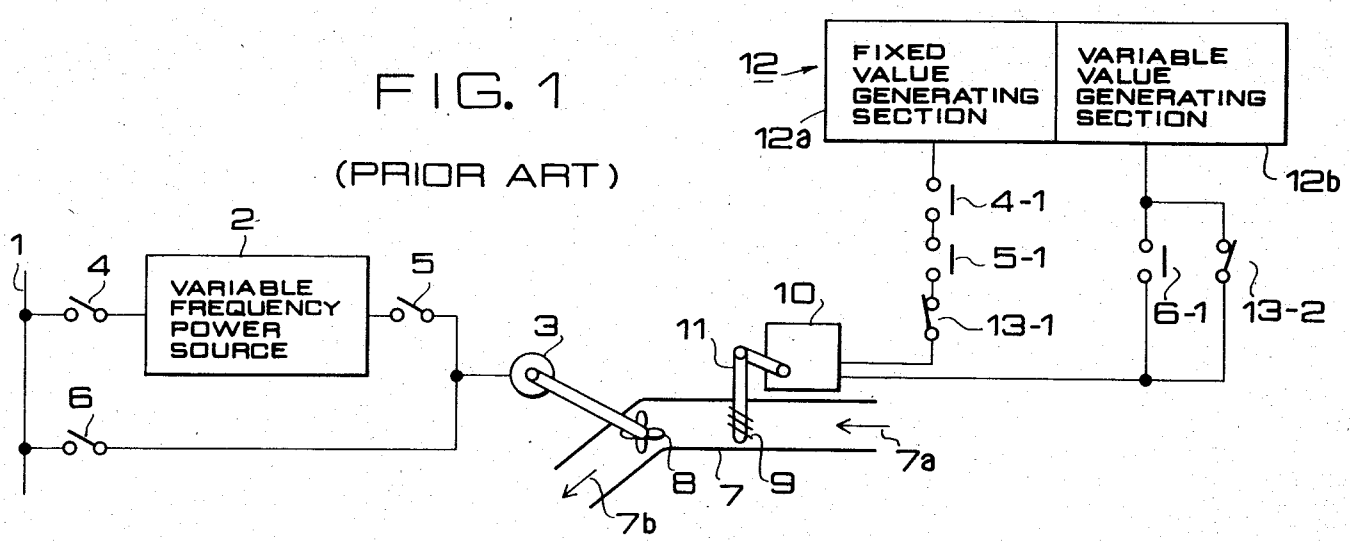
FIG. 1 (PRIOR ART)
FIG. 1 is a block diagram showing a construction of a conventional air flow controlling apparatus.
Figure 2:
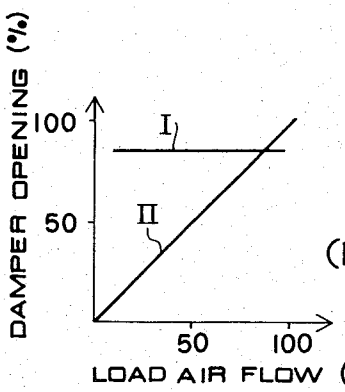
FIG. 2 (PRIOR ART)
FIG. 2 is a diagram showing relationships between a load air flow and the opening of a damper in the apparatus of FIG. 1.
Figure 5:
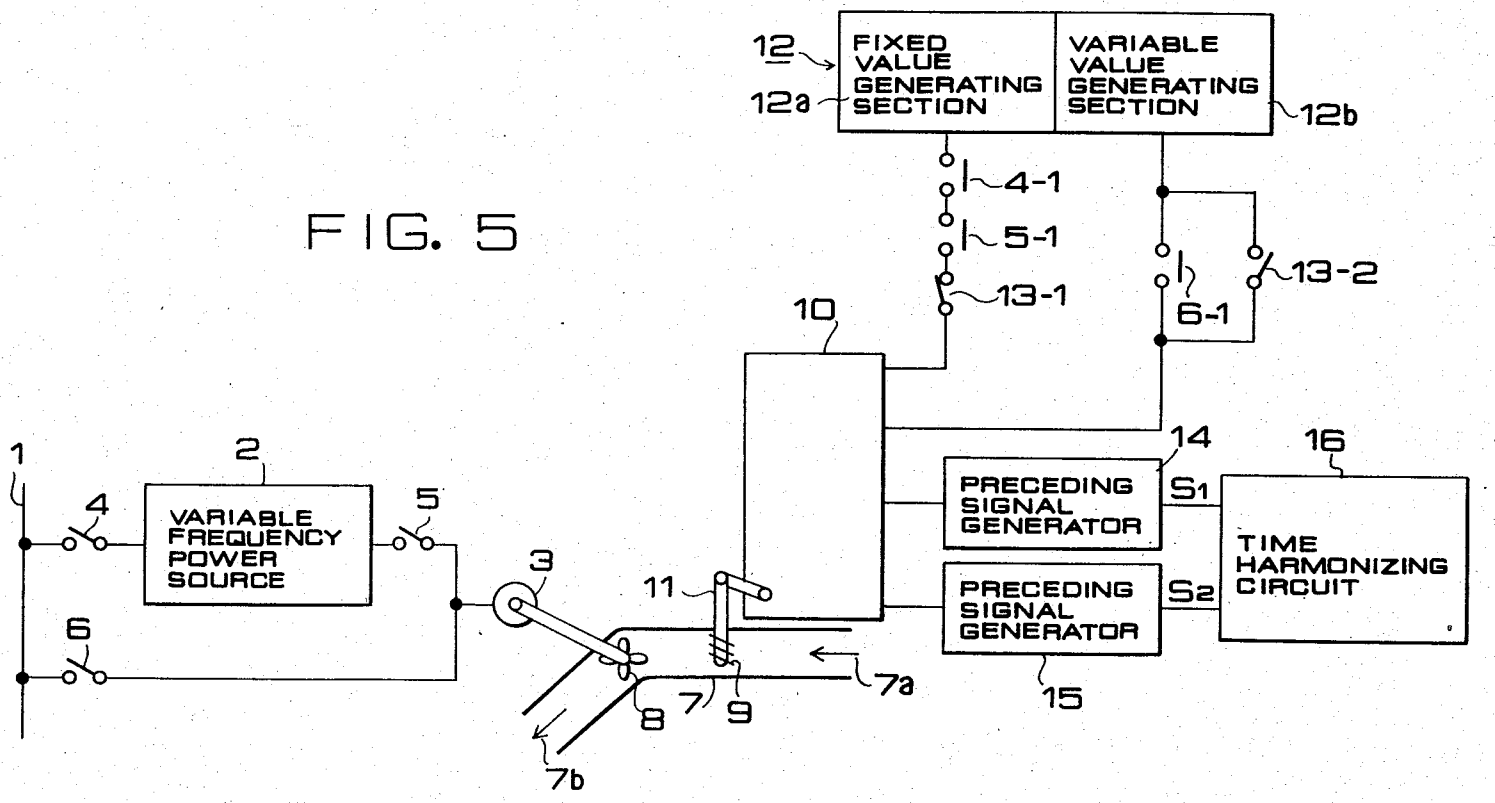
FIG. 5 is a block diagram showing a construction of an air flow controlling apparatus according to the present invention.

Referring first to FIG. 5 which illustrates an air flow controlling apparatus according to the present invention, reference numeral 1 designates a commercial power source (C power source), 2 a variable frequency power source (V power source), 3 an electric motor, reference numerals 4, 5 and 6 designate each a switch, 4-1, 5-1 and 6-1 each a contact of the switch 4, 5 or 6, 4c 5c and 6c each a coil for throwing in of the switch 4, 5 or 6, 4T, 5T and 6T each a coil for switching off of the switch 4, 5 or 6, reference numeral 7 designates an air course, 8 a ventilator, 9 a damper, 10 an air course resistance controlling mechanism 11 a connecting bar, 12 a controlling value generator, 12a a fixed value generating section, 12b a variable value generating section 12b, and reference numerals 13-1 and 13-2 designate each an opening pattern change-over switch. Since these elements are substantially the same as those of the conventional air flow controlling apparatus as shown in FIG. 1, like parts are designated by like reference numerals and detailed description thereof is omitted herein.

Further, reference numerals 14 and 15 designate each a preceding controlling signal generator for producing a preceding controlling signal for adjusting the opening of the damper 9 prior to operations of the switches 4 to 6 upon changing over between the power sources, the preceding controlling signal generator 14 being related to changing over from the C power source 1 to the V power source, and the preceding controlling signal generator 15 being related to changing over from the V power source 2 to the C power source 1. Further, reference numeral 16 designates a time harmonizing circuit for providing to the preceding controlling signal generators 14, 15 an instruction to deliver a signal and for providing a condition changing instruction to the switches 4 to 6.

Figure 6:
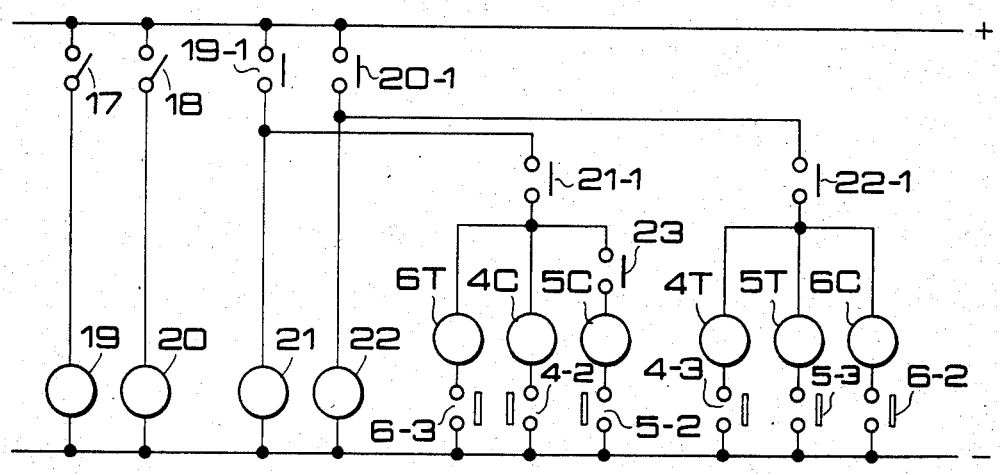
FIG. 6 is a circuit diagram of a time harmonizing circuit of the apparatus of FIG. 5.

FIG. 6 is a relay circuit diagram showing details of a construction of the above described time harmonizing circuit 16.

In FIG. 6, reference numeral 17 designates a switch for providing an instruction to change over from the C power source 1 to the V power source 2, 18 a switch for providing an instruction to change over from the V power source 2 to the C power source 1, 19 a relay connected in series to the changing over instructing switch 17 between positive and negative electrodes of a controlling power source, 20 another relay connected in series to the changing over instructing switch 18 between positive and negative electrodes of the controlling power source, and reference numerals 19-1 and 20-1 designate contacts of the relays 19 and 20, respectively. Closing signals of the 19-1, 20-1 make instructing signals to the preceding controlling signal generators 14 and 15, respectively. Further, reference numerals 21 and 22 designate timers connected in series to the contacts 19-1 and 20-1, respectively, while 21-1 and 22-1 designate contacts of the timers 21 and 22, respectively. The contacts 21-1, 22-1 connected in series to the contacts 19-1, 20-1, respectively, are closed after lapse of preset periods of time of the timers 21, 22 after closing of the contacts 19-1, 20-1. Reference numeral 23 denotes a V power source activating switch connected in series to the contact 20-1 for providing an activating instruction to connect the V power source 2 to the electric motor 3, and the V power source activating switch is closed at a suitable point of time after lapse of the preset time of the timer 22. Reference numerals 4T, 5T and 6T designate coils for switching off of the switches 4, 5 and 6, respectively, 4C, 5C and 6C coils for throwing in of the switches 4, 5 and 6, respectively, 4-2, 5-2 and 6-2 mechanical contacts for controlling durations of the throwing in coils 4C, 5C to 6C to short periods of time, respectively, and 4-3, 5-3 and 6-3 mechanical contacts for controlling durations of the switching off coils 4T, 5T and 6T to short periods of time, respectively. Serial circuits including the coil 6T and the contact 6-3, the coil 4C and the contact 4-2, and the switch 23, the coil 5C and the contact 5-2 are connected in parallel to each other between the contact 21-1 and the negative electrode of the controlling power source, while serial circuits including the coil 4T and the contact 4-3, the coil 5T and the contact 5-3, and the coil 6C the contact 6-2 are connected in parallel to each other between the contact 22-1 and the negative electrode of the controlling power source.

Figure 3:
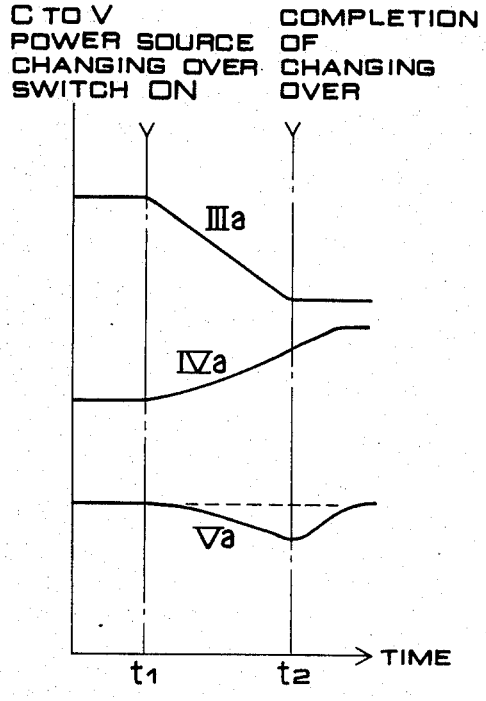
FIG. 3 (PRIOR ART)
FIG. 3 is a diagram showing variations relative to time of the rotational frequency of an electric motor, the opening of the damper and the air flow when power supply in the conventional air flow controlling apparatus is changed over from a commercial power source to a variable frequency power source.
Figure 4:
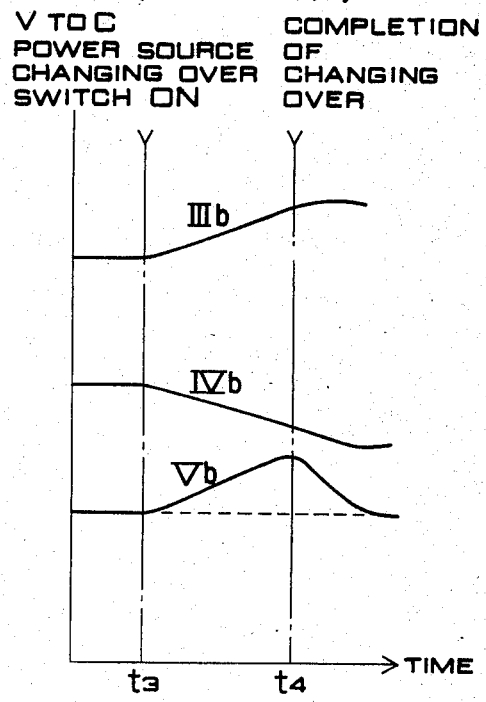
FIG. 4 (PRIOR ART)
FIG. 4 is a similar view showing such variations when power supply is oppositely changed over from the variable frequency power source to the commercial power source.
Figure 8:
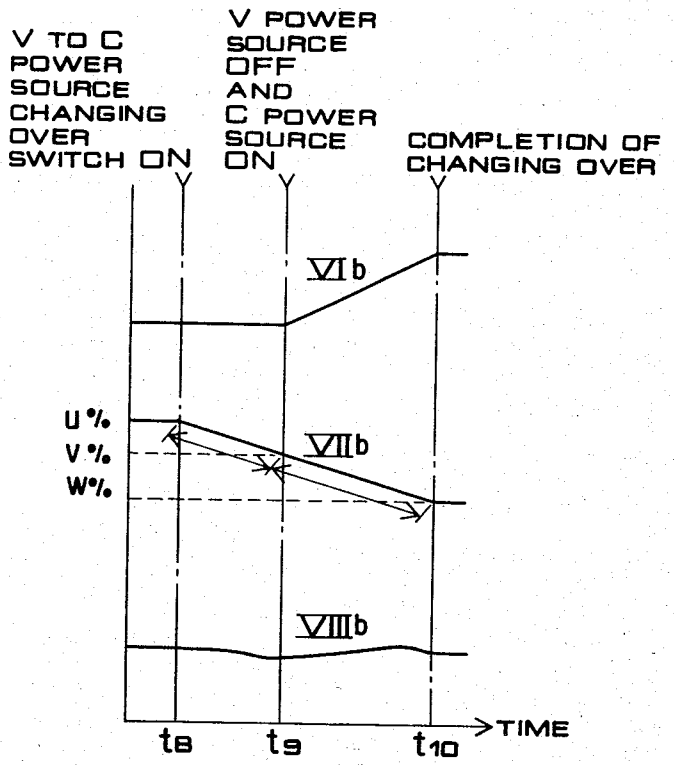
FIG. 8 is a similar view showing such variations when power supply is oppositely changed over from the variable frequency power source to the commercial power source.
Figure 7:
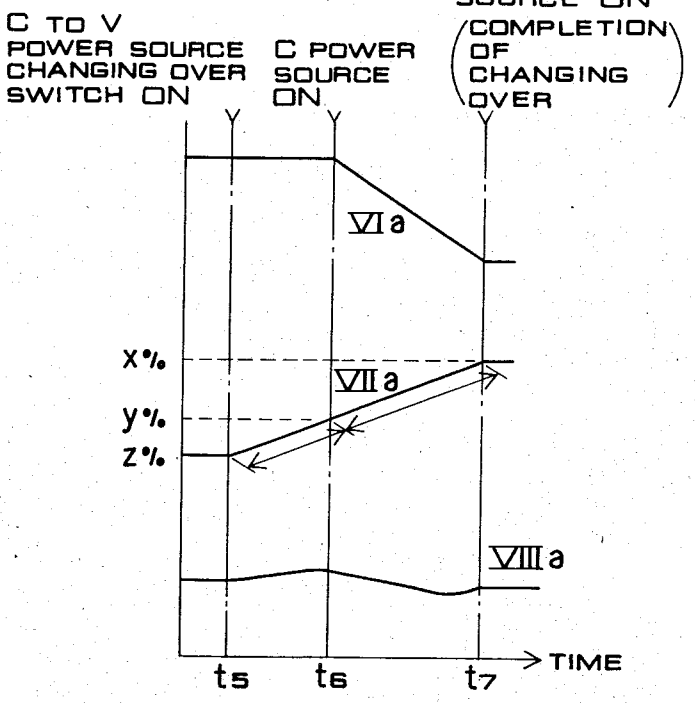
FIG. 7 is a diagram showing variations relative to time of the rotational frequency of an electric motor, the opening of a damper and the air flow when power supply in the apparatus of FIG. 5 is changed over from a commercial power source to a variable frequency power source.

FIGS. 7 and 8 are diagrams showing varying characteristics upon changing over between the two power sources in the present embodiment and correspond to FIGS. 3 and 4, respectively. In FIGS. 7 and 8, curved lines VI*a* and VI*b* illustrate variations relative to time of the rotational frequency of the electric motor 3, curved lines VII*a* and VII*b* illustrate variations of the opening of the damper 9 relative to the time, and curved lines VIII*a* and VIII*b* illustrate variations of the air flow relative to the time.

Also in the air flow controlling apparatus which has such a construction as described above, controlling of the air flow in a normal condition is substantially the same as that of the conventional apparatus, and hence description thereof is omitted herein while only changing over operations between two power sources will be described below.

After a changing over instruction between the power sources has been received, at first a controlling signal $S_1$ or $S_2$ is delivered from the time harmonizing circuit 16 to activate the preceding controlling signal generator 14 or 15. The signal generator 14 or 15 thereupon provides a preceding controlling signal which varies in accordance with a prescribed function to the air course resistance controlling mechanism 10 to open or close the damper 9 accordingly. Then, after lapse of the predetermined period of time after production of the signal $S_1$ or $S_2$, a changing over action between the two power sources is effected while leaving under a followup control of the damper 9.

Further details will be described below in reference to FIGS. 6 to 8. At first, changing over from the C power source 1 to the V power source 2 will be described. If the C to V changing over switch 17 is thrown in at a time $t_5$ as shown in FIG. 7, the relay 19 is rendered operative to close the contact 19-1 so that an activating signal $S_1$ as shown in FIG. 5 is delivered. As a result, the opening begins to vary as shown by the curved line VII*a* of FIG. 7 and at the same time the timer 21 starts a counting operation. Then, the timer 21 comes to operate at a time $t_6$ as shown in FIG. 7 whereupon the contact 21-1 is closed to energize the switching off coil 6T of the switch 6 and the throwing in coil 4C of the switch 4 at once so that supply of power to the electric motor 3 is stopped to cause the rotational frequency thereof to be reduced as shown by the curved line VI*a* of FIG. 7. On the other hand, the closing of the switch 4 renders the V power source 2 operative, and thereafter at a time $t_7$ as shown in FIG. 7 at which a rotational frequency determined by supply of power from the V power source 2 is reached, the V power source activating switch 23 is thrown in so that the throwing in coil 5C of the switch 5 is excited to close the switch 5, thereby completing the intended changing over to the V power source 2. It is to be noted that, in order to prevent a long duration of energization of a high electric current, excitation of the throwing in coils 4C and 5C and the switching off coil 6T is limited to a short period of time by opening and closing control of the contacts 4-2, 5-2 and 6-3. This period of time is set to a time sufficient to allow the switches 4 to 6 to complete their changing actions of status.

Now, description will be given of changing over from the V power source 2 to the C power source 1. If the V to C changing over switch 18 is thrown in at a time $t_8$ as shown in FIG. 8, the relay 20 is rendered operative to deliver an activating signal $S_2$ as shown in FIG. 5 so that the opening begins to vary as shown by the curved line VII*b* of FIG. 8 and at the same time the timer 22 begins a counting operation. Then, the timer 22 comes to operate at a time $t_9$ as shown in FIG. 8 whereupon the contact 22-1 is closed to energize the switching off coil 4T of the switch 4, the switching off coil 5T of the switch 5 and the throwing in coil 6C of the switch 6 at once so that supply of power to the electric motor 3 is immediately changed over from the V power source 2 to the C power source 1. Thereafter at a time $t_{10}$ as shown in FIG. 8 at which a rotational frequency determined by supply of power from the C power source 1 is reached, the rotational frequency becomes stable, thereby completing the intended changing over operation. It is to be noted that, also in this case, excitation of the switching off coils 4T and 5T and the throwing in coil 6C is limited to a short period of time by opening and closing control of the contacts 4-3, 5-3 and 6-2.

How to determine a preceding control amount of the opening of the damper 9 upon such a changing over operation between power sources will be described below.

The C power source 1 has a rated frequency. Hence, if the frequency of the V power source 2 after an intended changing over operation is set to a predetermined frequency, a variation of the opening of the damper 9 corresponding to a difference between frequencies before and after the changing over operation from the C power source to the V power source or vice versa (the difference is proportional to a difference between rotational frequencies of the electric motor 3) is definitely determined by an air flow function or the like. Also, the amount of variation of the opening within which the damper 9 can follow a change of the frequency in corresponding relationship is determined, and this amount does not always coincide with the amount which is determined by the above described air flow function or the like. Now, a change of the opening determined by the air flow function or the like is represented as x-z % as shown in FIG. 7 and a variation of the opening when it follows a change of the frequency is represented as x-y %. Thus, if the variation of the opening is left to following to the variation of the frequency, it will be short by y-z % within the period of time of the variation of the frequency. Hence, in order that the variation of the opening by y-z % may be completed before the V power source 2 is connected to the electric motor 3, a preceding control signal representing the amount of variation is delivered from the preceding control signal generator 14 to the air course resistance controlling mechanism 10. As a result, reduction of the frequency and variation of the opening of the damper 9 come to an end substantially at a same point of time, and hence the variation of an air flow can be limited to a minimum.

Also upon changing over from the V power source 2 to the C power source 1, a preceding controlling amount is determined in a similar manner. Now, a variation of the opening determined by the air flow function or the like upon this changing over is represented as u-w % as shown in FIG. 8 and a variation of the opening when it follows a variation of the frequency is represented as v-w %. Thus, if the variation of the opening is left to following to the variation of the frequency, it will be short by u-v % within the period of time of the variation of the frequency. Hence, a preceding control signal representing the amount of variation by u-v % is delivered from the preceding control signal generator 15.

While the foregoing description is given of the example of an air flow controlling apparatus which is applied for controlling of a damper of a boiler fan, it may otherwise be applied for controlling of any other air course resistance controlling mechanism such as for controlling a vane or the like, and it may be applied not only to a boiler but also to any other object of control. Further, while the air flow controlling apparatus of the embodiment includes a pair of separate preceding controlling signal generators 14 and 15, they may otherwise be integrated into a single preceding controlling signal generator or else they may be included in the controlling value generator 12. In addition, while, in order to facilitate the description, it is illustrated in the drawings that outputs of the controlling value generators 14 and 15 are delivered a particular fixed time before changing over between the C power source and the V power source, such a time is not necessarily fixed and may be a function of the opening of the damper of the like upon starting of the apparatus since a period of time necessary for controlling the damper varies depending upon an air flow when the system is run.

As apparent from the foregoing description, according to the present invention, in changing over between a C power source and a V power source, an air course controlling mechanism which has low responsiveness is rendered operative prior to connection of a new power source to an electric motor. Accordingly, the air flow controlling apparatus of the invention is advantageous in that, upon such a changing over operation, harmonization between controlling of an air flow by varying a rotational frequency and controlling of an air flow by means of an air course resistance controlling mechanism can be attained and hence a variation of an air flow can be restricted to a lower level.

What is claimed is:

1. An air flow controlling apparatus of the type which includes a damper located in an air course, a ventilator for feeding a wind by way of said damper, an electric motor for driving said ventilator, a changing over means for alternatively connecting said electric motor to a commercial power source or a variable frequency power source, and a damper controlling means for controlling the opening of said damper to obtain a desired air flow, said air flow controlling apparatus comprising:

(a) a preceding controlling signal generating means responsive to an instruction to change over from said commercial power source to said variable frequency power source or vice versa for delivering a preceding controlling signal to said damper controlling means to vary the opening of said damper prior to operation of said changing over means; and (b) a changing over time harmonizing means for rendering said changing over means operative after lapse of a predetermined period of time after delivery of the preceding controlling signal;

(c) said preceding controlling signal generating means including a first preceding controlling signal generator responsive to a changing over instruction to change over from said commercial power source to said variable frequency power source for delivering a first preceding controlling signal to said damper controlling means;

(d) said first preceding controlling signal having a value which can increase the opening of said damper in accordance with a predetermined function for a period of time from a point of time at which the changing over instruction to change over from said commercial power source to said variable frequency power source is received to another point of time at which said changing over means is rendered operative.

2. An air flow controlling apparatus of the type which includes a damper located in an air course, a ventilator for feeding a wind by way of said damper, an electric motor for driving said ventilator, a changing over means for alternatively connecting said electric motor to a commercial power source or a variable frequency power source, and a damper controlling means for controlling the opening of said damper to obtain a desired air flow, said air flow controlling apparatus comprising:

(a) a preceding controlling signal generating means responsive to an instruction to change over from said commercial power source to said variable frequency power source or vice versa for delivering a preceding controlling signal to said damper controlling means to vary the opening of said damper prior to operation of said changing over means; and (b) a changing over time harmonizing means for rendering said changing over means operative after lapse of a predetermined period of time after delivery of the preceding controlling signal;

(c) said preceding controlling signal generating means including a second preceding controlling signal generator responsive to a changing over instruction to change over from said variable frequency power source to said commercial power source for delivering a second preceding controlling signal to said damper controlling means;

(d) said second preceding controlling signal having a value which can decrease the opening of said damper in accordance with a predetermined function for a period of time from a point of time at which the changing over instruction to change over from said variable frequency power source to said commercial power source is received to another point of time at which said changing over means is rendered operative.

* * * * *